US007948240B2

(12) United States Patent
Kawase

(10) Patent No.: US 7,948,240 B2
(45) Date of Patent: May 24, 2011

(54) ABNORMALITY DIAGNOSING APPARATUS FOR A GLOW PLUG

(75) Inventor: Kenichiro Kawase, Okazaki (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 384 days.

(21) Appl. No.: 12/299,197

(22) PCT Filed: Feb. 6, 2008

(86) PCT No.: PCT/JP2008/051914
§ 371 (c)(1),
(2), (4) Date: Oct. 31, 2008

(87) PCT Pub. No.: WO2008/096772
PCT Pub. Date: Aug. 14, 2008

(65) Prior Publication Data

US 2009/0261833 A1 Oct. 22, 2009

(30) Foreign Application Priority Data

Feb. 8, 2007 (JP) ..... 2007-029186

(51) Int. Cl.
*F02P 17/00* (2006.01)
*F02P 19/02* (2006.01)

(52) U.S. Cl. ..... 324/378; 123/179.6

(58) Field of Classification Search ..... 324/378; 123/179.6
See application file for complete search history.

(56) References Cited

U.S. PATENT DOCUMENTS 4,483,284 A 11/1984 Andreasson
4,500,775 A * 2/1985 Sangu et al. ..... 219/497
4,862,370 A * 8/1989 Arnold et al. ..... 701/113
6,215,310 B1 * 4/2001 Petrovich et al. ..... 324/378
7,188,597 B2 * 3/2007 Rodriguez et al. ..... 123/179.6
2008/0208440 A1 * 8/2008 Hiramatsu ..... 701/113

FOREIGN PATENT DOCUMENTS

| | | | |
|---|---|---|---|
| EP | 1 350 951 | A2 | 10/2003 |
| EP | 1 410 952 | A2 | 4/2004 |
| EP | 1 321 668 | B1 | 4/2005 |
| ES | 2 240 318 | T3 | 10/2005 |
| JP | 2002-115641 | A | 4/2002 |
| JP | 2003-293926 | A | 10/2003 |
| JP | 2004-137983 | A | 5/2004 |
| SU | 65289 | | 10/1945 |
| SU | 1299520 | A3 | 3/1987 |

* cited by examiner

*Primary Examiner* — Jeff Natalini
(74) *Attorney, Agent, or Firm* — Sughrue Mion, PLLC

(57) ABSTRACT

An abnormality diagnosing apparatus for a glow plug 8 provided in an engine 1. The glow plug 8 is energized by power supply from a battery 7 during a glow period from starting of the engine 1 to completion of engine starting. First, on the basis that power output edf from an alternator 12, which is driven to charge the battery 7, is within an appropriate range and that the variation Δedf of the power output edf at the end of the glow period is not more than a reference value a, it is determined if there is a possibility of an abnormality in the glow plug 8. After the determination, the plug 8 is energized temporarily. Then, on the basis that the power output edf is within a modified appropriate range, which has a greater upper limit than the previous appropriate range and that the variation Δedf while the plug 8 is energized is not more than the reference value a, it is determined that the an abnormality actually occurred. Accordingly, failure of determination of the presence of an abnormality due to deterioration of the battery 7 is prevented when an abnormally has actually occurred.

5 Claims, 5 Drawing Sheets

ABNORMALITY DIAGNOSING APPARATUS FOR A GLOW PLUG

TECHNICAL FIELD

The present invention relates to an abnormality diagnosing apparatus for a glow plug provided in an internal combustion engine.

BACKGROUND ART

In vehicles such as automobiles equipped with an internal combustion engine, various kinds of electrical equipment are energized at the time of engine starting. Initially, the starter is driven to crank the engine. During the cranking of the engine, fuel is supplied to a combustion chamber of the engine. When engine starting is complete, the engine starts operating in a self-supporting manner. After this self-supporting operation starts, the driving of the starter is stopped.

As internal combustion engines in vehicles, for example, compression-ignited internal combustion engines including diesel engines are used. In these engines, to improve the ignition performance and the combustion characteristics of fuel during a predetermined period from engine starting to the completion of engine starting, a glow plug is provided in the combustion chamber. The glow plug produces heat when energized by power supply from a battery. The glow plug is energized during a glow period, i.e., a predetermined period from engine starting to the completion of engine starting.

Regarding the glow plug, abnormalities such as continued energization of the plug or failure of energization of the plug occur. To address this, in Patent Document 1, the battery is charged to an appropriate charged state via the power generation by an alternator. Thus, when the glow plug is changed between the energized state and the de-energized state, the presence of an abnormality in the glow plug is determined based on the amount of variation in the power output of the alternator. In the case when continued energization of the plug or failure of energization of the plug occurs, the variation in the power output of the alternator is small. Thus, if it is determined that the variation is not more than a reference value, the presence of an abnormality in the glow plug may be determined. The reference value is a value set for determining the presence of an abnormality in the glow plug. More specifically, if the variation is the reference value or less, it is determined that an abnormality has occurred in the glow plug.

As described above, it is desirable for the presence of an abnormality in the glow plug to be determined based on the condition that the power output of the alternator is within a predetermined appropriate range. This is because the determination of the presence of an abnormality in the glow plug can not be performed accurately when the power output of the alternator is abnormal. The appropriate range is, for example, a range from a lower limit A to an upper limit B, wherein the lower limit A is the value that is greater than the minimum value of the power output of the alternator by a predetermined amount and the upper limit B is the value that is smaller than the maximum value of the power output by a predetermined amount.

Concerning change of the glow plug between the energized state and the de-energized state for determining the presence of an abnormality in the glow plug, the change of the glow plug from the energized state to the de-energized state occurs at the time the glow period ends after completion of engine starting (after the engine starts operating in a self-supporting manner) and is preferably used. This is because the engine operates in a self-supporting manner such as idling when the glow period ends and energization of the various kinds of electrical equipment remains unchanged, which is different from at the time of engine starting, whereby the power output of the alternator is unlikely to be unstable.

Regarding variation in the power output of the alternator when the glow plug is changed from the energized state to the de-energized state, both the reactivity of the glow plug and the amount of the variation are smaller than in the case where the glow plug is changed from the de-energized state to the energized state. The reason for this is as follows. When the glow plug is changed from the de-energized state to the energized state, greater electro motive force is required to bring the glow plug, which was cold in the de-energized state, into the energized state, whereby the variation becomes greater than the case where the glow plug is changed from the de-energized state to the energized state accordingly. Therefore, if the presence of an abnormality in the glow plug is determined based on the amount of the variation in the power output of the alternator when the glow plug is changed from the energized state to the de-energized state only, such determination is not necessarily accurate.

To address this problem, if it is determined that an abnormality is present in the glow plug based on the fact that the amount of variation in the power output of the alternator, in accordance with the change of the glow plug from the energized state to the de-energized state, is not more than the reference value at the timing immediately after the end of the glow period, the determination that an abnormality is present in the glow plug is not affirmed immediately, but it is determined that there is a possibility of an abnormality in the glow plug. Then, based on this determination, the presence of an abnormality in the glow plug may be determined again. More specifically, after the glow period ends, the glow plug is energized temporarily. Then, it is determined if the variation in the power output of the alternator during the energization is not more than the reference value. If the determination is affirmative, it is affirmed that that an abnormality has occurred in the glow plug. Thus, the presence of an abnormality is affirmed. This re-determination of the presence of an abnormality in the glow plug improves the accuracy of the previous determination that an abnormality is present in the glow plug. This re-determination process is also performed based on the condition that the power output of the alternator is within a predetermined appropriate range.

Meanwhile, in the case where the battery has deteriorated, the power output of the alternator has a tendency to increase and it is possible that the power output will exceed the upper limit B of the appropriate range when the energization of the glow plug starts, even if the power output is within the appropriate range at the time when the glow period ends, whereby re-determination of the presence of an abnormality in the glow plug may fail. Particularly, in the case where the power output of the alternator is near the upper limit B of the appropriate range at the time when the glow period ends, it is highly possible that the power output will exceed the upper limit B of the appropriate range when the energization of the glow plug starts. The reason for this is that when the glow plug is changed from the de-energized state to the energized state, greater electro motive force is required to bring the glow plug, which was cold in the de-energized state, into the energized state, whereby the power output of the alternator increases accordingly.

As described above, re-determination of the presence of an abnormality in the glow plug fails if the power output of the alternator exceeds the upper limit B of the predetermined range when the glow plug is temporarily energized to perform the re-determination. For the reason that the determination that there is a possible abnormality in the glow plug may be performed but the re-determination of the presence of an abnormality in the glow plug cannot be performed, the determination of the presence of an abnormality may be impossible even when an abnormality has actually occurred in the glow plug.

Patent Document 1: Japanese Published Laid-Open Patent Publication No. 2002-115641

SUMMARY OF THE INVENTION

An object of the present invention is to provide an abnormality diagnosing apparatus for a glow plug that prevents failure of determination of the presence of an abnormality due to the deterioration of the battery when an abnormally is actually occurring.

To achieve the above object, according to the present invention, an abnormality diagnosing apparatus for a glow plug in an internal combustion engine is provided. The glow plug is energized by power supply from a battery during a glow period from the starting of the engine to the completion of engine starting. The battery is charged to an appropriate charged state via the power generation of an alternator. The apparatus comprises a tentative-determination section for determining the possibility of an abnormality, an affirming section for affirming that an abnormality is occurring in the glow plug, and a modifying section. On the basis that power output of the alternator is within a predetermined appropriate range, the tentative-determination section determines if a variation in the power output of the alternator is not more than a reference value when the glow plug is changed from the energized state to the de-energized state at the end of the glow period. The reference value is a value set for determining the presence of an abnormality of the glow plug. This is performed on the basis that the variation in the power output of the alternator is not more than the reference value. The tentative-determination section determines whether there is a possibility of an abnormality in the glow plug. When the tentative-determination section determines that there is a possibility of an abnormality in the glow plug, the affirming section operates to energize the glow plug temporarily after the end of the glow period. On the basis that the power output of the alternator is within the appropriate range, the affirming section determines if the variation in the power output of the alternator is not more than the reference value at the time of the energization of the glow plug. On the basis that the variation in the power output of the alternator is not more than the reference value, the affirming section determines that an abnormality has occurred in the glow plug. On the basis that the tentative-determination section determines that there is a possibility of an abnormality in the glow plug, the modifying section modifies an upper limit of the appropriate range to increase.

In determining the presence of an abnormality in the glow plug in the affirming section, the appropriate range is modified so that the upper limit of the appropriate range is increased. However, this does not cause a problem. The reason is as follows. As a prerequisite for the determination of the possibility of occurrence of an abnormality in the glow plug in the tentative-determination section, the condition that the power output of the alternator is within the appropriate range before the modification had already been satisfied. Thus, even if the power output edf of the alternator has a tendency to increase at the start of the energization of the glow plug when the presence of abnormality is determined in the affirming section, the possibility that the power output of the alternator takes an inappropriately great value is negligibly low.

BEST MODE FOR CARRYING OUT THE INVENTION

An embodiment in accordance with the present invention applied to a diesel engine for an automobile will be described with reference to FIGS. 1 to 5.

Figure 1:
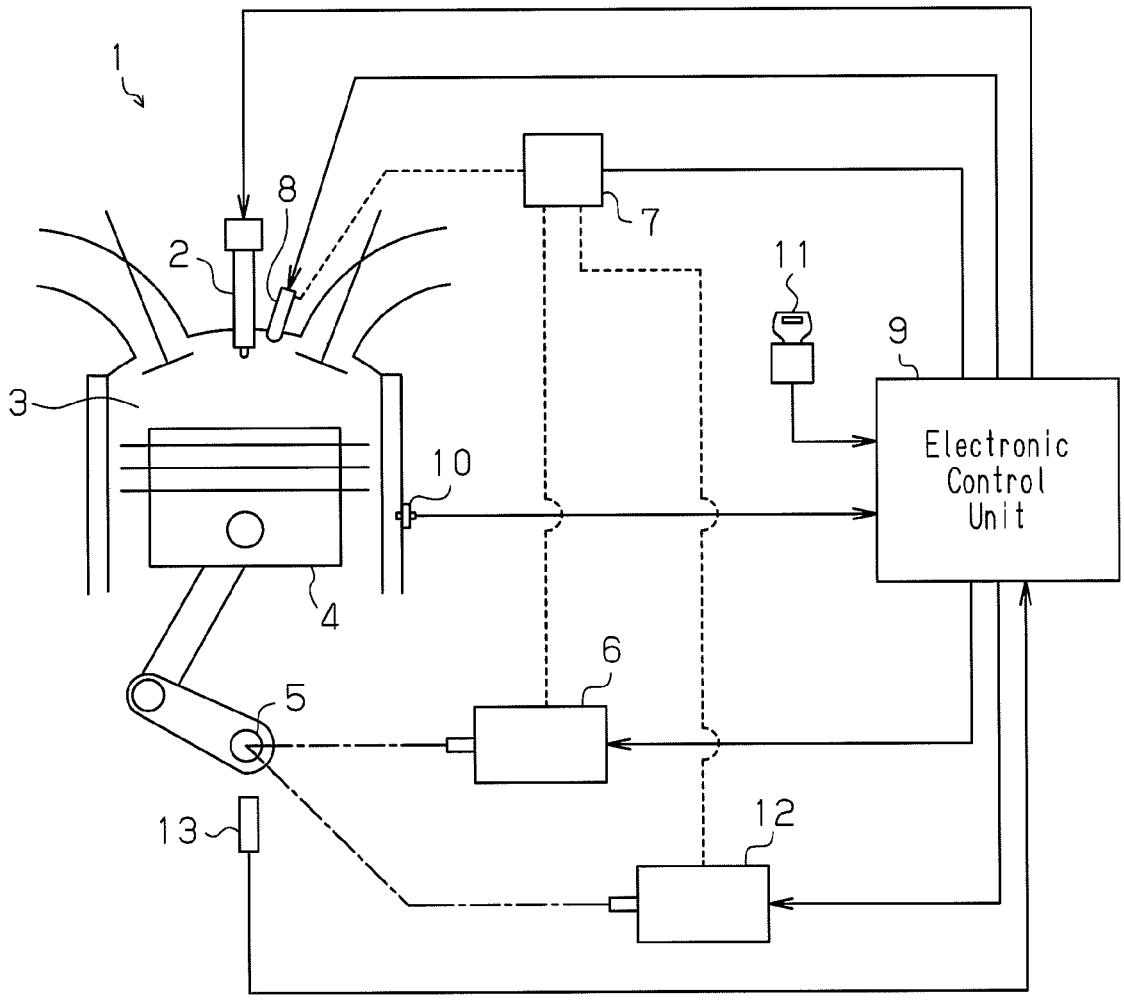
FIG. 1 is a schematic diagram illustrating an engine to which one embodiment of an abnormality diagnosing apparatus is applied.

As illustrated in FIG. 1, in an engine 1, fuel is injected from an injector 2 into a combustion chamber 3 to be combusted. This causes a piston 4 to reciprocate so that a crankshaft 5 rotates. A starter 6 and an alternator 12 are connected to the crankshaft 5. The starter 6 forcibly rotates (cranks) the crankshaft 5 at the time of starting of the engine 1. The alternator 12 is driven by the rotation of the crankshaft 5 to generate power for charging the battery 7.

When the engine 1 is started, the starter 6 is driven by power supply from the battery 7 to crank the engine 1. During the cranking, fuel is injected into the combustion chamber 3 thereby starting operation of the engine 1. A glow plug 8 is provided in the combustion chamber 3 of the engine 1 to improve the ignition performance and the combustion characteristics of fuel in the combustion chamber 3 during a predetermined period from engine starting to the completion of engine starting (referred to as the glow period hereinafter). The glow plug 8 produces heat when energized by power supplied from the battery 7.

The alternator 12 includes a voltage regulator to regulate the power output and duty-controls the voltage regulator based on a duty command value to generate power output edf corresponding to the duty command value. The duty command value is set as a variable to keep the battery 7 in an appropriately charged state based on the battery voltage. In particular, the duty command value is increased as the battery voltage decreases. Thus, the power output edf of the alternator 12 is small when the glow plug 8 is de-energized while the power output edf is large when the glow plug 8 is energized.

In the automobile equipped with the engine 1, an electronic control unit (ECU) 9 is provided to control the operation of the engine 1 or driving of the automobile. The electronic control unit 9 includes a CPU for performing various operations relating to drive controls of the various kinds of electronic equipment, a ROM for storing programs or data necessary for the controls, a RAM for storing calculation results of the CPU temporarily, and I/O ports for receiving or transmitting signals from or to the outside.

Various sensors such as a water temperature sensor 10 and a rotation speed sensor 13 as well as an ignition switch 11 are connected to the input ports of the electronic control unit 9. The water temperature sensor 10 detects the temperature of cooling water for the engine 1. The rotation speed sensor 13 detects engine rotational speed. The ignition switch 11 is switched by a driver of the automobile to either of four positions: "off", "accessories", "on", "start", to output the signal corresponding to the current position out of these positions. Drive circuits for the injector 2, the starter 6, the glow plug 8, and an alternator 12 are connected to the output ports of the electronic control unit 9.

The electronic control unit 9 outputs command signals to the drive circuits for the equipment connected to the output ports based on the traveling state of the automobile, states of the various kinds of equipment of the automobile, and the operating state of the engine 1 that are obtained from the detection signals transmitted from the above sensors. In this way, the electronic control unit 9 performs various controls such as control of fuel injection from the injector 2, control of driving of the starter 6 during engine starting, control of energization of the glow plug 8, and control of the power output of the alternator 12.

Now, the above various controls for starting of the engine 1 will be described.

When the ignition switch 11 is switched from "off" to "accessories" and "on", in order, by the driver while the engine 1 is stopped, various kinds of electronic equipment in the automobile, such as an electronic control unit 9, are energized. Then, when the ignition switch 11 is switched from "on" to "start", the starter 6 powered by the battery 7 is driven to start cranking the engine 1. During cranking, fuel injection from the injector 2 to the combustion chamber 3 causes the engine 1 to start. After starting of the engine 1 is complete and the engine 1 begins operating in a self-supporting manner, the ignition switch 11 is switched from "start" to "on" by the driver. Then, the power supply to the starter 6 is shut off to accordingly stop the driving of the starter 6.

Figure 2:
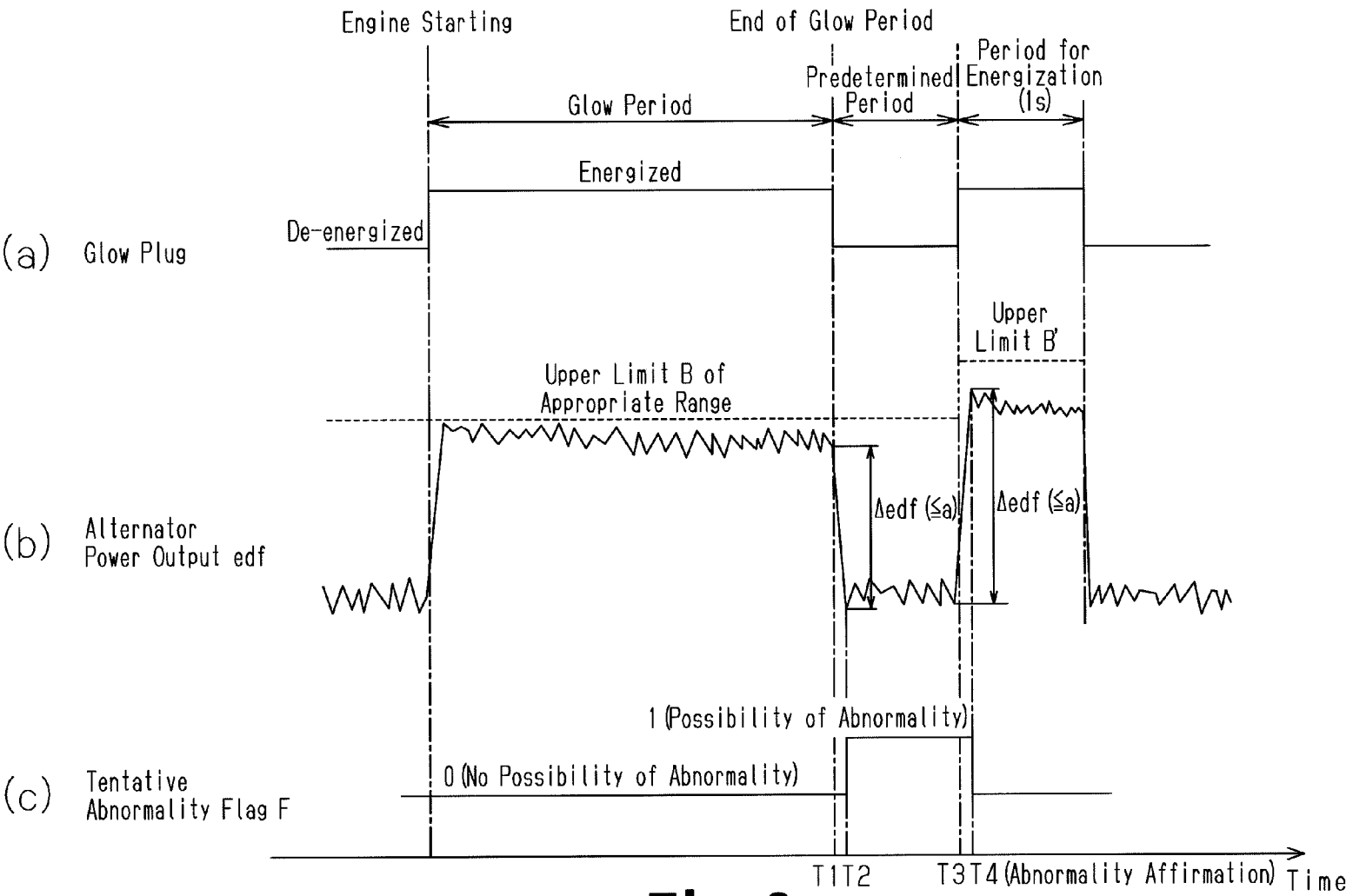
FIG. 2 is a time chart illustrating an example of (a) energization of a glow plug, (b) the change in the power output of an alternator, and (c) setting of a tentative abnormality flag, during the diagnosis of an abnormality in the glow plug.

FIG. 2(*a*) illustrates energization of the glow plug 8 immediately after engine starting. When the ignition switch 11 is turned "on" for starting the engine 1, the length of the glow period is determined based on the temperature of cooling water for the engine 1 at that time. The glow period is a period from the starting of the engine 1 to the completion of engine starting when the glow plug 8 is energized to improve the ignition performance and the combustion characteristics of fuel in the combustion chamber 3. The length of the glow period is set longer as the temperature of the cooling water decreases. The glow plug 8 is energized after starting of the engine 1 until the glow period elapses. Then, the glow plug 8 is switched from an energized state to a de-energized state at the end of the glow period ($T_1$) after starting of the engine 1 is completed.

FIG. 2(*b*) illustrates the variation in the power output edf of the alternator 12 immediately after the engine starting. As described above, the alternator 12 is drive-controlled based on the duty command value that is set as variable depending on the battery voltage to generate power output edf corresponding to the duty command value. The duty command value is set as variable within the range from a minimum value 0% to a maximum value 100%. Accordingly, the power output edf, which corresponds to the duty command value, may be also represented by the variable within an appropriate range from the minimum value 0% to the maximum value 100%. The power output edf is small when the glow plug 8 is de-energized since the decrease in the battery voltage is less while the power output edf is large when the glow plug 8 is energized since the decrease in the battery voltage is great. Accordingly, the change of the glow plug 8 between the energized state and the de-energized state causes the power output edf to change greatly. At engine start, the power output edf increases greatly in accordance with the change of the glow plug 8 from the de-energized state to the energized state. Then, at the end ($T_1$) of the glow period, the power output edf decreases greatly in accordance with the change of the glow plug 8 from the energized state to the de-energized state.

Next, an outline of abnormality diagnosis for determining the presence of an abnormality in the glow plug 8 is described with reference to FIG. 2.

The determination of the presence of an abnormality is performed on the basis of the variation Δed in the power output edf of the alternator 12 when the glow plug 8 is changed between the energized condition and the de-energized condition. For example, if abnormalities occur, such as the continued energization of the plug or failure of energization of the plug, the variation Δedf becomes small. Thus, the presence of an abnormality can be determined based on whether the variation Δedf is not more than a reference value a, wherein the reference value is a value set for determining the presence of an abnormality of the glow plug 8. More specifically, if the variation Δedf is the reference value a or less, it is determined that abnormality has occurred in the glow plug 8.

Regarding the glow plug 8 changing between the energized state and the de-energized state for determining the presence of the glow plug 8, the glow plug 8 changing from the energized condition to the de-energized condition at the end of the glow period is used. The reason for this is that the engine operates in a self-supporting manner such as idling when the glow period ends and energization of the various kinds of electrical equipment remain unchanged, different from at the time of engine starting. Thus, the power output edf of the alternator is not likely to be unstable. This is preferable in determining the presence of an abnormality in the glow plug 8 based on the variation Δedf.

Conditions for performing the determination of the presence of an abnormality in the glow plug 8 include the following conditions (1) to (8). When all the conditions are satisfied, execution of the determination of the presence of an abnormality is allowed.

(1) The battery voltage is an acceptable lower limit or higher.

(2) The engine rotational speed is within a predetermined range near idle rotational speed.

(3) The variation in the engine rotational speed is small.

(4) A predetermined period has passed after engine start, wherein the predetermined period is a period that is longer than the period required from engine start until the engine starts operating in a self-supporting manner.

(5) The power output edf of the alternator 12 is within the appropriate range.

(6) External equipment powered by the battery does not work.

(7) The water temperature sensor is normal and the temperature of cooling water is cold enough to allow the energization of the glow plug 8 during the glow period.

(8) The ignition switch 11 is "ON".

Among the above conditions, condition (5) is the condition for preventing failure of accurate determination of the presence of an abnormality in the glow plug 8 in the situation that the power output edf of the alternator 12 is abnormal. For the appropriate range in condition (5), an appropriate range from the lower limit A, a value that is greater than the minimum value of the power output edf by a predetermined amount (e.g., 20% greater than the minimum value) to the upper limit B, or a value that is smaller than the maximum value of the power output edf by a predetermined amount (e.g., 90% of the maximum value) is used.

Under the situation that all the above conditions (1) to (8) are satisfied, the glow plug 8 is switched from the energized condition to the de-energized condition at the end of the glow period. Then, the determination of the presence of an abnormality in the glow plug 8 is performed as described.

It is noted that, regarding the variation edf in the power output of the alternator 12 when the glow plug 8 is changed from the energized state to the de-energized state, both the reactivity of the glow plug 8 and the amount of the variation Δedf are smaller than in the case where the glow plug 8 is changed from the de-energized state to the energized state. The reason for this is as follows. When the glow plug 8 is changed from the de-energized state to the energized state, greater electromotive force is required to bring the glow plug 8, which was cold in the de-energized state, into the energized state, whereby the variation Δedf accordingly becomes greater than in the case where the glow plug 8 is changed from the de-energized state to the energized state. Therefore, if the presence of an abnormality in the glow plug 8 is determined based on the amount of the variation Δedf in the power output 8 at the end of the glow period only, such determination is not necessarily accurate.

To address this, if it is determined that an abnormality is present in the glow plug 8 based on the fact that the amount of variation Δedf is not more than the reference value a at the timing immediately after the end of the glow period, the determination that an abnormality is present is not affirmed immediately but it is determined that there is a possibility of an abnormality in the glow plug 8 ($T_2$) . Then, based on this determination, the presence of an abnormality in the glow plug 8 is re-determined if all the conditions (1) to (8) are satisfied. More specifically, after a predetermined period has passed from the end of the glow period, the glow plug 8 is energized temporarily. Then, it is determined if the variation Δedf in the power output of the alternator 12 during the energization is not more than the reference value a. After the start of the energization (after the timing $T_3$) and at the time when it is determined that the variation Δedf is not more than the reference value a ($T_4$), it is determined that an abnormality has occurred in the glow plug 8 and the presence of an abnormality is affirmed. This re-determination of the presence of an abnormality in the glow plug 8 improves the accuracy of the previous determination that an abnormality was present in the glow plug.

Meanwhile, the battery 7 deteriorates over time and the battery voltage of such a deteriorated battery 7 has a tendency to decrease. Thus, the power output edf of the alternator 12 has a tendency to increase in association with the deterioration of the battery 7. In such a case, it is possible that the power output edf exceeds the upper limit B of the appropriate range when the energization of the glow plug 8 starts, even if the power output edf was within the appropriate range at the time the glow period ends. That is, since the above condition (5) is not satisfied, the re-determination of the presence of an abnormality in the glow plug 8 may fail. Particularly, as illustrated in FIG. 2(*b*), in the case where the power output edf is near the upper limit B of the appropriate range at the end of the glow period ($T_1$), it is highly possible that the power output edf will exceed the upper limit B of the appropriate range when the temporal energization starts ($T_3$) . The reason for this is, when the glow plug 8 is changed from the de-energized state to the energized state, greater electromotive force is required to bring the glow plug 8, which was cold in the de-energized state, into the energized state, whereby the power output edf of the alternator accordingly becomes greater.

As described above, when the glow plug 8 is energized temporarily to determine the presence of an abnormality in the glow plug 8, it is possible that the power output edf becomes greater than the upper limit B of the appropriate range, whereby the re-determination of the presence of an abnormality in the glow plug 8 may fail. That is, when an abnormality actually occurs in the glow plug 8, it can be determined whether there is a possibility of an occurrence of an abnormality but the affirmation of that occurrence may fail since the re-determination of the presence of an abnormality in the glow plug 8 can not be performed.

To address this, in the present embodiment, when it is determined that there is a possibility of an abnormality in the glow plug 8, the upper limit B of the appropriate range (ranging from A to B) used in condition (5) is increased to the upper limit B' as indicated in FIG. 2(*b*) by the broken line after the timing $T_3$ to modify the appropriate range. Then, the glow plug 8 is energized temporarily in order to determine the presence of an abnormality in the glow plug 8. If all the conditions (1) to (8) are satisfied, the determination of the presence of an abnormality in the glow plug 8 is performed.

In this case, when the energization of the glow plug 8 starts (after the timing $T_3$) to determine the presence of an abnormality in the glow plug 8, the power output edf does not exceed the upper limit B' and thus remains within the appropriate range (the range from A to B') even if the power output edf has a tendency to increase due to the deterioration of the battery 7. As a result, the event of the power output edf exceeding the appropriate range, condition (5) not being satisfied, and the determination of the presence of an abnormality in the glow plug 8 failing, are all prevented. That is, failure of determination of the presence of an abnormality due to deterioration of the battery 7 is prevented when an abnormality actually occurs in the glow plug 8.

In determining the presence of an abnormality in the glow plug 8, the upper limit B of the appropriate range used in condition (5) is increased to the upper limit B'. However, this does not cause a significant problem for the following reason. That is, a prerequisite for the determination of the presence of an abnormality in the glow plug 8 is performed after the glow period ends (after the timing $T_1$), in which the condition (5) had already been satisfied that the power output edf must be within the appropriate range (the range from A to B). Accordingly, even if the power output edf has a tendency to increase at the start of the energization of the glow plug 8, the possibility that the power output edf takes an inappropriately great value is negligibly low.

Next, procedural steps for determining the presence of an abnormality in the glow plug 8 are described with reference to FIGS. 3 to 5.

Figure 3:
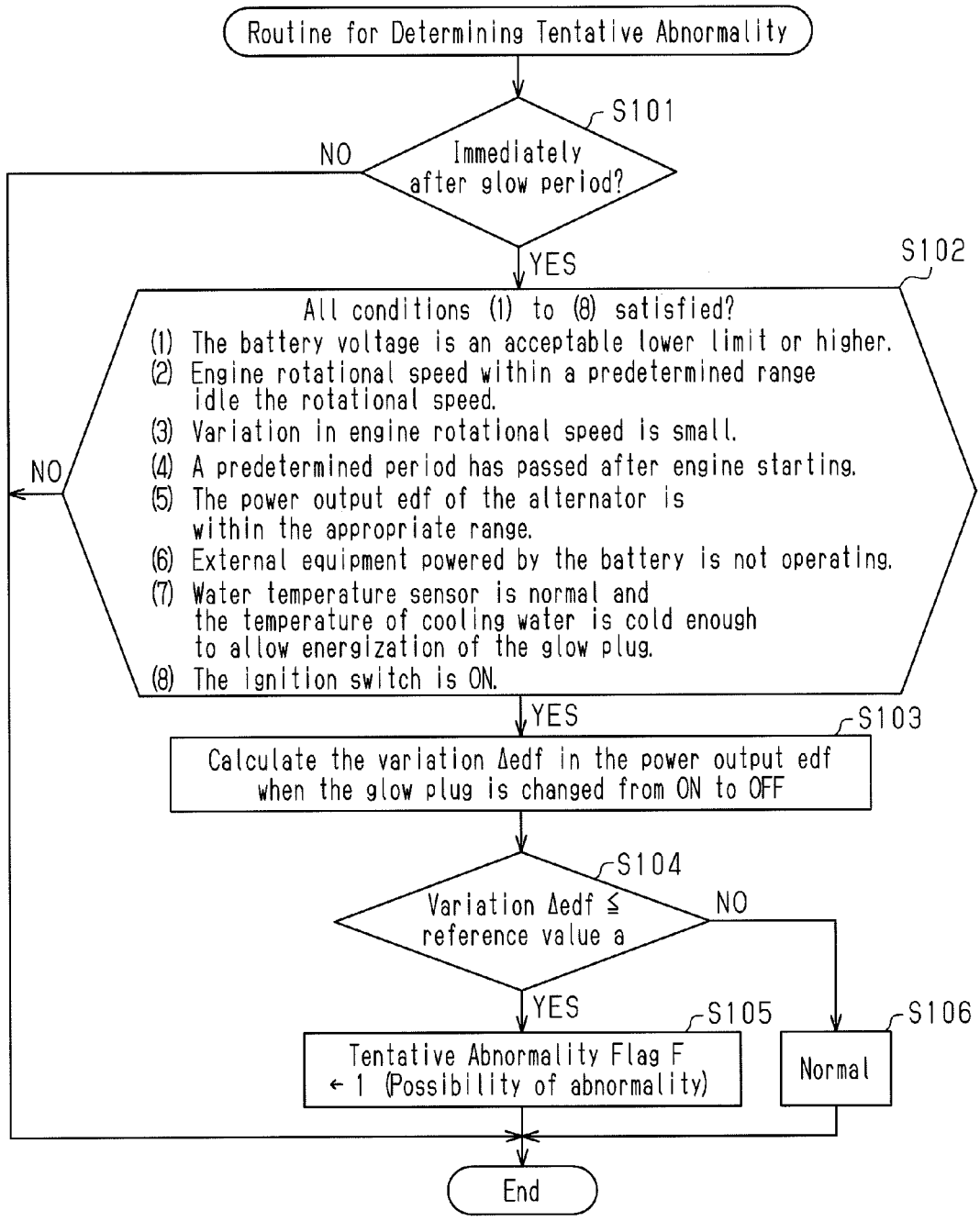
FIG. 3 is a flowchart illustrating procedure for determining if there is a possibility of an abnormality in the glow plug.

FIG. 3 is a flowchart illustrating a routine for determining immediately after the end of the glow period that there is a possibility of an abnormality in the glow plug 8. This routine is performed by the electronic control unit 9 at predetermined time intervals in an interrupt manner.

In this routine, first, whether or not the current time is immediately after the end of the glow period (immediately after the timing $T_1$ in FIG. 2) is determined (S101). If it is immediately after the end of the glow period (S101: YES), whether all conditions (1) to (8) as described above are satisfied or not is determined (S102). The appropriate range used in condition (5) for this determination is the appropriate range from the lower limit A to the upper limit B.

If the determination is affirmative in step S102, the variation Δedf in the power output edf of the alternator 12 is determined when the glow plug 8 is changed from the energized condition (ON) to the de-energized condition (OFF) in accordance with completion of the glow period (S103). More specifically, the variation Δedf is the value obtained by subtracting the value of the power output edf after the glow plug 8 is turned off from the value of the power output edf immediately before the glow plug 8 is turned off. The value for the power output edf after the glow plug 8 has been turned off, is the value of the power output edf at the above timing (the timing $T_2$ in FIG. 2), which is the timing at which the time required for the power-off of the glow plug 8 to have an effect on the power output edf has passed after the glow plug 8 has been turned from on to off.

After that, it is determined if the calculated variation Δedf is not more than the reference value a, wherein the reference value is a value set for determining the presence of an abnormality of the glow plug 8 (S104). If the determination is negative, the glow plug is determined to be normal (S106). If the determination is affirmative, a tentative abnormality flag F, which is used for determining the possibility of the presence of an abnormality in the glow plug 8 is changed from "0" (no possibility of an abnormality) to "1" (possibility of an abnormality)" as indicated after the timing $T_2$ in FIG. 2(*c*) (S105).

Figure 4:
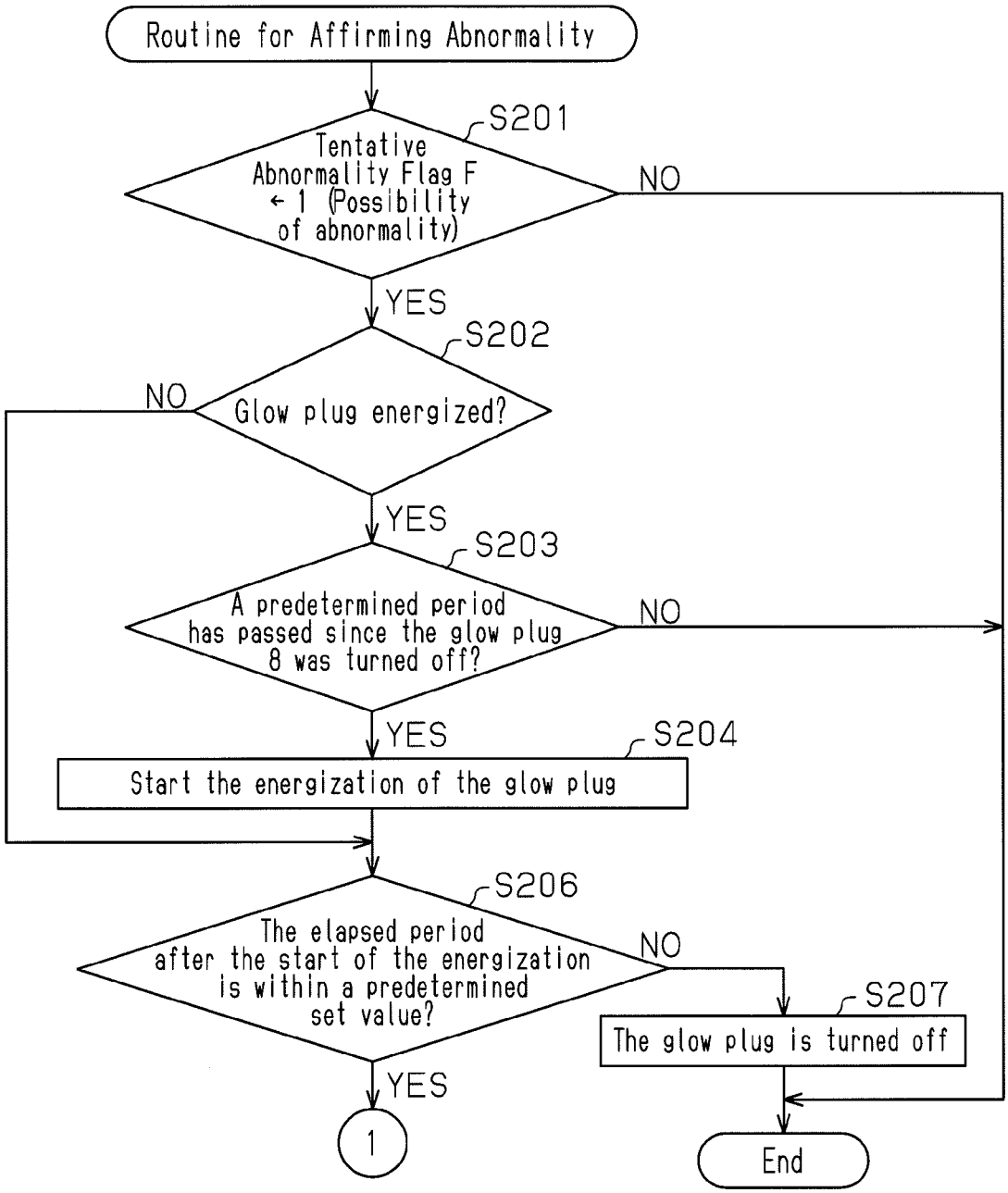
FIG. 4 is a flowchart illustrating procedure for determining the presence of an abnormality in the glow plug.
Figure 5:
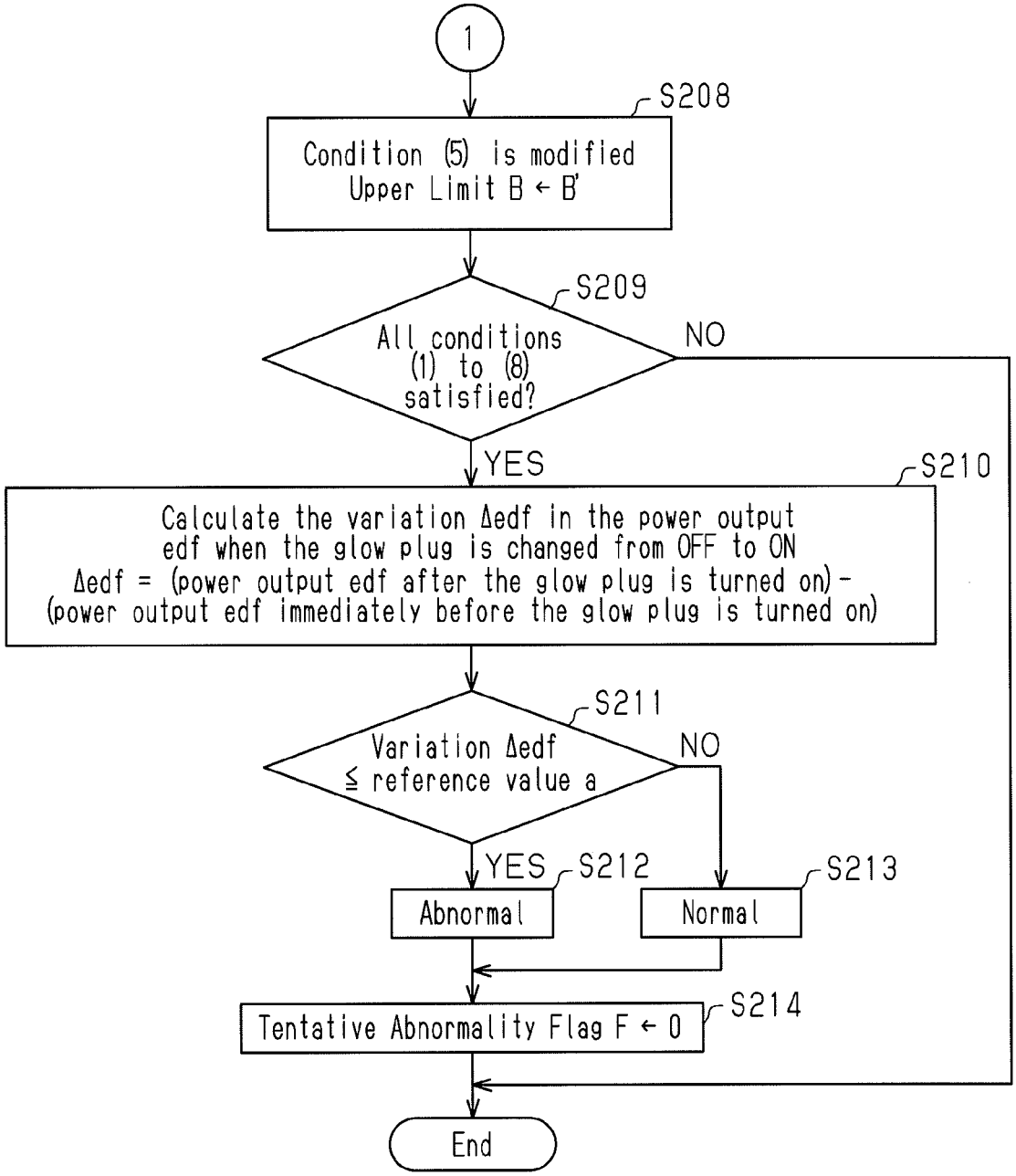
FIG. 5 is a flow chart illustrating procedure for determining the present of an abnormality in the glow plug.

FIGS. 4 and 5 are flowcharts illustrating a routine for affirming the presence of an abnormality in the glow plug 8 based on the determination that there is a possibility at present of an abnormality in the glow plug 8. This routine is performed by the electronic control unit 9 at predetermined time intervals in an interrupt manner.

In this routine, first, whether the tentative abnormality flag F is "1" (possibility of abnormality) or not is determined (S201 in FIG. 4). If the determination is affirmative, a series of steps to energize the glow plug 8 temporarily are performed to determine the presence of an abnormality in the glow plug 8 (S202 to S207).

In this series of steps, provided that the glow plug 8 is de-energized (OFF) (S202: NO), it is determined whether a predetermined period has passed or not since the glow plug 8 was turned off previously(S203). If the determination is affirmative (S203: YES), the energization of the glow plug 8 starts (S204). The energization of the glow plug 8 continues while the elapsed period after the start of the energization is within a predetermined set value (S206: YES) and the energization of the glow plug 8 is stopped when the elapsed period becomes longer than the predetermined set value (S206: NO) (S207).

That is, the energization of the glow plug 8 is performed after a predetermined period from the end of the glow period ($T_1$ to $T_3$ in FIG. 2) until the period corresponding to the set value has elapsed. The set value is a time sufficiently short not to have an adverse effect on the lifetime of the glow plug 8 but long enough for the power output edf to be stable after the start of the energization. For example, the set value is one second (1s).

As described above, when the energization of the glow plug 8 starts (at $T_3$), the appropriate range used for the condition (5) is modified (S208 in FIG. 5). More specifically, the appropriate range is modified such that the upper limit B of the appropriate range is increased to the upper limit B' as illustrated by the dashed line at the timing that is later than the timing $T_3$ in FIG. 2*b*(*b*). Thus, the appropriate range is modified so that the appropriate range from A to B' is used as the appropriate range in condition (5). After that, whether all the above conditions (1) to (8) are satisfied or not is determined (S209). The appropriate range used for condition (5) that is considered in the above determination is the range from the lower limit A to the upper limit B'.

If the determination in step S209 is affirmative, the variation Δedf of the power output edf of the alternator 12 is calculated when the glow plug 8 is changed from the de-energized condition (OFF) to the energized condition (ON) associated with the energization of the glow plug 8 (S210). More specifically, subtraction of the power output edf immediately before the glow plug 8 from the power output edf after the glow plug 8 is turned on leaves the variation Δedf. The power output edf at the timing at which the time required for power-on of the glow plug 8 to have an effect on the power output edf has passed after the glow plug 8 is turned from off to on is used as the power output edf after the glow plug 8 is turned on.

After that, it is determined if the calculated variation Δedf is not more than the reference value a to determine the presence of an abnormality in the glow plug 8 (S211). If the determination is negative, it is determined that the glow plug is normal (S213) whereas if the determination is affirmative, it is determined that an abnormality occurred in the glow plug 8 (S212). After the determination of the presence of an abnormality in the glow plug 8 (at the timing later than the timing $T_4$ in FIG. 2(C)), the tentative abnormality flag F is reset to "0" (S214).

After the determination is found to be negative in step S209, the processing following step S201 is repeated. Therefore, after the glow period ends, when all the conditions (1) to (8) are not satisfied during the first energization of the glow plug 8 and the determination of whether the glow plug 8 is normal or abnormal fails, energization of the glow plug 8 is conducted again through the processing of steps S202 to S207 in FIG. 4. The energization of the glow plug 8 is repeated until either a determination of abnormal in step S212 or a determination of normal in step S213 is made.

The above embodiment has the following effects.

First, based on the determination that there is a possibility of an abnormality in the glow plug 8, the glow plug 8 is temporarily energized to determine the presence of an abnormality in the glow plug 8. In this regard, the upper limit B of the appropriate range (ranging from A to B) used for the above condition (5) is increased to the upper limit B', whereby the appropriate range is modified. Accordingly, even when the power output edf of the alternator 12 has a tendency to increase due to deterioration of the battery, the power output edf does not exceed the upper limit of the appropriate range after the energization starts. Rather, the above condition (5) is satisfied and the determination of the presence of an abnormality in the glow plug 8 may be performed. Accordingly, failure of determination of the presence of abnormality due to deterioration of the battery 7 is prevented when an abnormally actually occurs in the glow plug 8.

Second, when condition (5) is not satisfied due to deterioration of the battery 7 during energization of the glow plug 8, the energization of the glow plug 8 is repeated until the determination of the presence of an abnormality in the glow plug 8 is completed. However, in this embodiment, the repetition of the energization of the glow plug 8 may be prevented.

Third, the determination of the presence of an abnormality in the glow plug 8 is performed immediately after energization of the glow plug 8 starts on condition that all of the conditions (1) to (8) are satisfied and at the timing in which the time required for the power-off of the glow plug 8 to have an effect on the power output edf has passed after the glow plug 8 is turned from on to off. Then, it is determined if the variation Δedf of the power output edf by that time is not more than the reference value a. If the determination is affirmative, it is determined that an abnormality occurred in the glow plug 8. If the determination is negative, it is determined that the glow plug is normal.

To perform more accurate determination of the presence of an abnormality in the glow plug 8, e.g., it is possible to perform such a determination based on whether the following conditions (A) and (B) are satisfies or not: (A) all the above conditions (1) to (8) are satisfied over the period when the energization of the glow plug 8 is performed, and (B) variation Δedf of the power output edf associated with the completion of the energization is not more than the reference value a. By determining that an abnormality is present in the glow plug 8 when both conditions (A) and (B) are satisfied, a more accurate determination of the presence of an abnormality in the glow plug 8 is possible. This is because the variation of the power output edf of the alternator 12 is great immediately after the energization starts and determining whether the variation Δedf of the power output edf is not more than the reference value a or not at the end of energization, at which the above variation ceases, is advantageous to make the determination of the presence of an abnormality in the glow plug 8 more accurate.

When such a determination of the presence of an abnormality in the glow plug 8 is taken, it is highly possible that the power output edf will exceed the appropriate range (the range from A to B' ) and that the above condition (A) is not satisfied during the period the glow plug 8 is temporarily energized in the case where the battery 7 deteriorates, whereby the determination of the presence of an abnormality in the glow plug 8 fails. As a result, in the event that the determination of the presence of an abnormality fails and in the event that the energization of the glow plug 8 is repeated are likely to occur, even when an abnormality actually occurs in the glow plug 8.

However, the determination of whether an abnormality occurred in the glow plug 8 or not or the determination whether the glow plug 8 is normal or not is performed under the circumstances where all the conditions (1) to (8) are satisfied, immediately after energization of the glow plug 8 starts, and at the timing in which the time required for the start of the energization to have an effect on the power output edf has passed. Accordingly, the occurrence of the above events is prevented.

The above embodiment may be modified as follows.

It is possible that the determination of the presence of an abnormality in the glow plug 8 is impossible immediately after the start of the energization of the glow plug 8, e.g., when any of conditions (1) to (8) became unsatisfied immediately after the start of the energization. In this case, the determination of the presence of an abnormality in the glow plug 8 may be performed immediately after the energization ends. In this regard, whether the variation Δedf of the power output edf at the end of the energization is not more than the reference value a or not is determined on condition that all the conditions (1) to (8) are satisfied. If this determination is affirmative, it is determined that an abnormality occurred in the glow plug 8. If the determination is negative, the glow plug 8 is determined to be normal. This configuration results in an effect that the opportunity to determine the presence of an abnormality in the glow plug 8 is increased.

Re-determination of the presence of an abnormality in glow plug 8 after the glow period ends may be performed as described in the third effect of the present embodiment. This allows a more accurate re-determination.

The period during which the energization of the glow plug 8 is performed, or the set value, may be modified as appropriate.

The lower limit A and the upper limit B of the appropriate range may be modified as appropriate.

The upper limit B', which is greater than the upper limit B, may be a maximum value (100%) the power output edf can take or any value between the maximum value (100%) and the upper limit B.

The lower limit A of the appropriate range may be modified to a value that is increased in accordance with the increase from the upper limit B to the upper limit B'.

The invention claimed is:

1. An abnormality diagnosing apparatus for a glow plug provided in an internal combustion engine, wherein the glow plug is energized by power supply from a battery during a glow period from the starting of the engine to the completion of the engine starting, wherein the battery is charged to an appropriate charged state via power generation from an alternator, the apparatus comprising:

a tentative-determination section for determining a possible abnormality, wherein, on the basis that power output of the alternator is within a predetermined appropriate range, the tentative-determination section determines if a variation in the power output of the alternator is not more than a reference value when the glow plug changes from an energized state to a de-energized state at the end of the glow period, the reference value being a value set for determining presence of an abnormality in the glow plug, and wherein, on the basis that the variation in the power output of the alternator is not more than the reference value, the tentative-determination section determines that there is a possibility of an abnormality in the glow plug;

an affirming section for affirming that an abnormality occurred in the glow plug, wherein, when the tentative-determination section determines that there is a possibility of an abnormality in the glow plug, the affirming section operates to energize the glow plug temporarily after the end of the glow period, wherein, on the basis that the power output of the alternator is within the appropriate range, the affirming section determines if the variation in the power output of the alternator is not more than the reference value when the glow plug is energized, and wherein, on the basis that the variation in the power output of the alternator is not more than the reference value, the affirming section determines that an abnormality has occurred in the glow plug;

a modifying section, wherein, based on the tentative-determination section determining that there is a possibility of an abnormality in the glow plug, the modifying section modifies an upper limit of the appropriate range by increasing the upper limit.

2. The apparatus according to claim 1, wherein the affirming section determines whether variation of the power output is not more than the reference value immediately after energization of the glow plug starts and at a timing in which time required for the start of the energization to have an effect on the power output of the alternator has passed, wherein if the determination is affirmative, it is determined that an abnormality occurred in the glow plug, whereas, if the determination is negative, it is determined that the glow plug is normal.

3. The apparatus according to claim 1, wherein the affirming section determines whether variation of the power output is not more than the reference value immediately after energization of the glow plug ends, wherein if the determination is affirmative, it is determined that an abnormality occurred in the glow plug, whereas, if the determination is negative, it is determined that the glow plug is normal.

4. The apparatus according to claim 1, wherein the modified upper limit is the maximum value the power output can take.

5. The apparatus according to claim 1, wherein the modifying section also modifies an upper limit of the appropriate range based on the determination by the tentative-determination section that there is a possibility of an abnormality in the glow plug.

* * * * *